United States Patent [19]

Alvarez

[11] 4,262,899

[45] Apr. 21, 1981

[54] ACCESSORY FOR EXERCISING ON A BICYCLE

[76] Inventor: Jorge G. Alvarez, Bolivar 451-3, Mexico 8 D. F., Mexico

[21] Appl. No.: 949,201

[22] Filed: Oct. 6, 1978

[51] Int. Cl.[3] ..... A63B 69/16

[52] U.S. Cl. ..... 272/73; 272/DIG. 4; 211/22; 280/293

[58] Field of Search ..... 272/73, DIG. 4, 132; 280/293; 211/17, 22

[56] References Cited

U.S. PATENT DOCUMENTS

| | | | |
|---|---|---|---|
| 553,373 | 1/1896 | Webber | 272/73 |
| 554,754 | 2/1896 | Webber | 272/73 |

FOREIGN PATENT DOCUMENTS

| | | | |
|---|---|---|---|
| 2458492 | 6/1976 | Fed. Rep. of Germany | 272/73 |
| 7414940 | 5/1975 | Netherlands | 272/73 |

*Primary Examiner*—Richard C. Pinkham
*Assistant Examiner*—Arnold W. Kramer

[57] ABSTRACT

A tubular frame, upon which a rear end of a bicycle is supported in elevated position, so that the rear wheel does not engage the ground, but engages a friction wheel, that retards the free rotational movement of the rear drive wheel, so that a rider upon the bicycle must apply physical effort during a pedaling operation; the frame including two vertical plates, between which a cylindrical fastener is supported, and to which the rear wheel of the bicycle is attached, and the device additionally including a horizontal bar carrying the friction wheel, the bar being adjustable in position, for changing the friction force against the bicycle wheel where adjustable locking of the bar comprises a forward clamp member having a tooth on the underside thereof selectively engaging between ratchet teeth upon the upper side of the bar with the bar being downwardly movable against a compression coil spring mounted on the frame so as to selectively disengage the teeth and a block mounted on the upper side of the bar for being pushed by the exerciser's foot either forwardly or rearwardly.

1 Claim, 2 Drawing Figures

ACCESSORY FOR EXERCISING ON A BICYCLE

This invention relates generally to exercising devices. More specifically, it relates to an accessory for exercising on a bicycle.

A principal object of the present invention is to provide an accessory that permits a person to exercise upon a stationary bicycle; the accessory including a friction wheel, which retards the free motion of the bicycle rear drive wheel, so that the rider must exert a physical force during pedaling operation.

Another object is to provide an accessory for exercising on a bicycle, wherein the friction force of the friction wheel against the drive wheel is adjustable, so that the rider can thus use either more or less force during the exercise.

Yet a further object is to provide an accessory for exercising on a bicycle, wherein the accessory can alternately be used as a bicycle stand, for parking a bicycle in an upright position, so that the bicycle requires less space than when leaning against a wall, lying upon a ground, or being supported upon a conventional kickstand.

Yet a further object is to provide an accessory, which alternately can serve for displaying bicycles in a salesroom.

Yet a further object is to provide an accessory, which can be manufactured to fit different sizes and types of bicycles, whether of national origin, or else which are imported, having standard sizes.

Other objects are to provide an accessory for exercising on a bicycle, which is simple in design, inexpensive to manufacture, rugged in construction, easy to use and efficient in operation.

These, and other objects, will be readily evident, upon a study of the following specification, and the accompanying drawing, wherein.

Figures 1, 2:
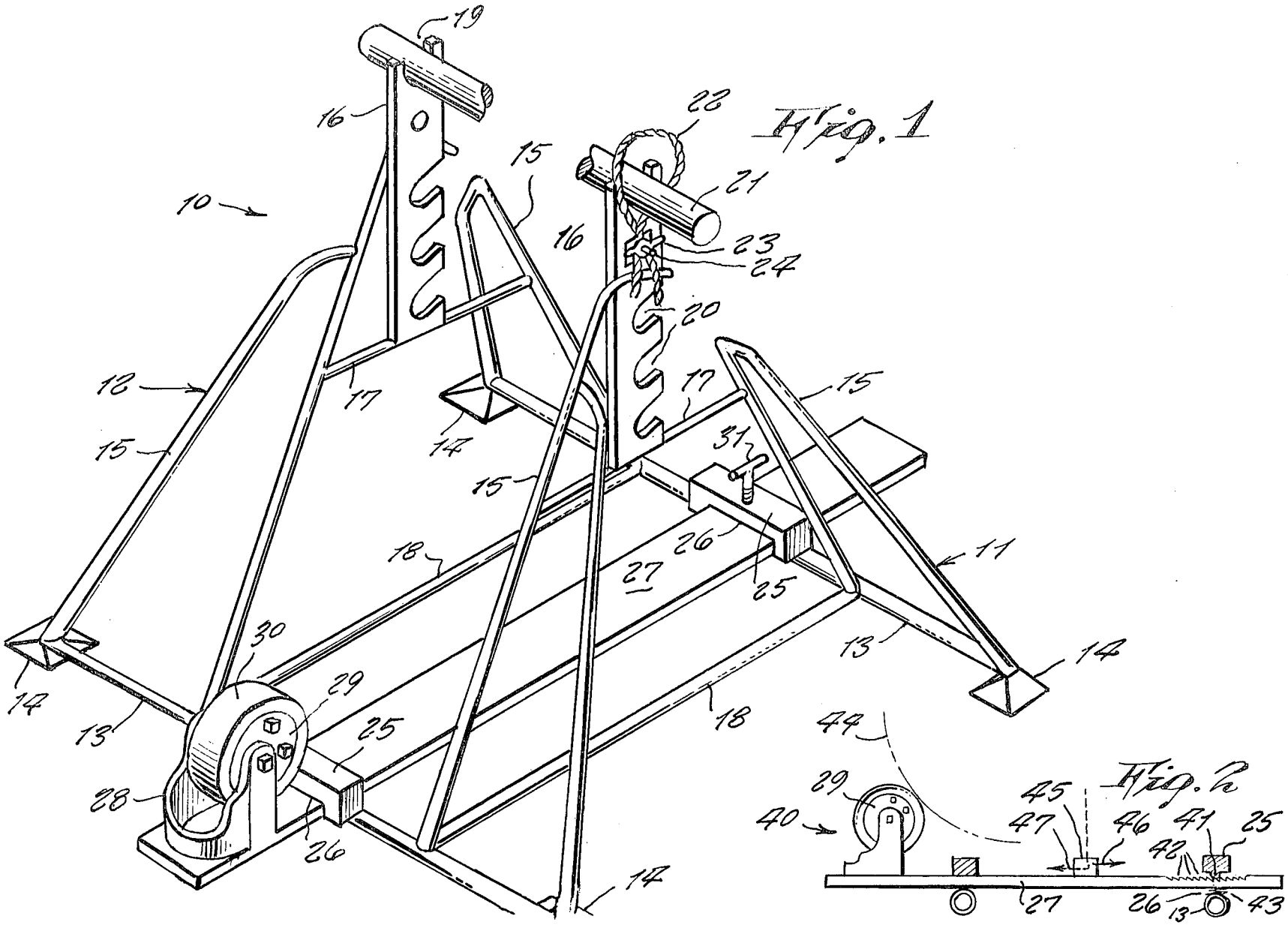
FIG. 1 is a perspective view of the present invention.
FIG. 2 is a fragmentary detail of a modified design of the invention, which permits a rider to adjust frictional force against the bicycle drive wheel, without the need of the rider to dismount, in order to accomplish the same.

Referring now to the drawing in greater detail, and more particularly to FIG. 1 thereof at this time, the reference numeral 10 represents an accessory for exercising on a bicycle which includes a forward, U-shaped frame 11, and a rear, U-shaped frame 12, each of which includes a tubular base member 13, which, at its outward ends, is mounted upon a foot 14, for placement upon a supporting surface, such as a ground or floor. Each frame, 11 and 12, also includes upright, tubular members 15.

The upper ends of the rear frame upright members 15 are each affixed to an upper portion to a vertical plate 16; the plates 16 being spaced apart from each other. A lower end of the plates 16 are supported upon cross braces 17, secured between upper portions of the frames 11 and 12, while a lower end of the frames are secured together by a lower cross brace 18.

The upper end of each plate 16 has a U-shaped notch 19, extending downwardly, and a forward edge of each of the plates is provided with a plurality of angularly, downwardly extending notches 20, so that an internally threaded, cylindrical fastener 21 can be supported horizontally between the plates, either in the notches 19, or 20, selectively. The cylindrical fastener is adapted for attachment to a rear axle of a bicycle that is intended to be supported upon the accessory 10.

In securing the cylindrical fastener to each of the plates 16, a cable 22 is passed around the cylindrical fastener, and the opposite ends thereof are then secured between a side of the plate and a wing nut 23, mounted on a bolt 24, which is secured to the plate. Each tubular base member 13 at its center, has an inverted, U-shaped clamp 25 mounted fixedly thereupon, so that there is an opening 26 formed under a center of the clamp, and an elongated, rectangular shaped bar 27 is adjustably slideable through the openings 26. Upon a rear end of the bar 27, there is mounted a bracket 28, that rotatably supports a wheel 29, having a rubber tire 30. The wheel 29 comprises a friction wheel for bearing against the periphery of the bicycle rear drive wheel, in order to impart a drag force thereagainst, so that it requires effort for a rider of the bicycle to pedal the rear wheel. This friction force is adjustable, by simply bringing the friction wheel either closer or further from the bicycle rear wheel. This adjustment is accomplished by sliding the bar 27 through the openings 26, and securing the bar in a selected position, by means of an adjustable lock screw 31, extending downwardly through a forward of the clamps 25, and bearing against the upper surface of the bar 27.

In operative use, it is now evident that the bicycle rear wheel is thus supported in elevated position, by means of the cylindrical fastener 21, supported in a selected of the notches of the plates 16. The rear wheel frictionally engages the friction wheel 29. A front wheel of the bicycle rests upon a floor or upon a ground.

In a modified design of the invention, shown in FIG. 2, an accessory 40 is a same as accessory 10, except that the forward clamp 25 includes a tooth 41, upon its underside, which engages selectively between ratchet teeth 42, upon the upper side of the bar 27. The opening 26, under the forward clamp 25, is sufficiently deep, so that the bar can be downwardly depressed against a compression coil spring 43, so that the teeth 41 and 42 can disengage.

In operative use, a bicycle rider, without dismounting, can apply more pressure between friction wheel 29 and bicycle rear wheel 44, by simply kicking with his foot against a block 45, mounted upon bar 27, into a direction as indicated by arrow 46. When the rider wishes to decrease the friction between the wheels, he simply first depresses the bar 27 downward against the compression coil spring 43, and then kicks the block 45 in a direction as indicated by arrow 47.

While various changes may be made in the detail construction, it is understood that such changes will be within the spirit and scope of the present invention, as is defined by the appended claims.

What I now claim is:

1. An accessory for exercising on a bicycle, comprising, forward and rearward, spaced-apart, generally U-shaped frame members, each said frame member having an elongated, tubular base member, each of said base members being provided with a foot at each of its ends for supporting said frame members upon a support surface, said base members also being provided with a pair of substantially vertical, upstanding tubular members, each upstanding tubular member being spaced apart and attached to opposite ends of said base member, said frame members being spaced apart in a generally parallel relationship and being attached to each other by a pair of perpendicularly extending, elongated, parallel spaced-apart tubular members, each of said parallel, spaced-apart tubular members having its ends attached to a base member of said forward and rearward frame members, forward and rearward U-shaped clamp members, each of said elongated, tubular base members having one of said clamp members attached thereon substantially equidistant the ends thereof, and equidistant from said parallel, spaced-apart tubular members, said clamp members having their free leg ends attached to said base members between the attached ends of said parallel, spaced apart tubular members, and extending upwardly therefrom, to form an opening between said base member and said clamp member, an elongated, substantially rectangular bar, said substantially rectangular bar being slidably received in said openings and locked therein by adjustable locking means, a pair of substantially rectangular shaped, horizontally spaced-apart plate members, each of said plate members being vertically attached to the upper end of an upstanding tubular member of said rearward frame member, each of said plate members being provided with a U-shaped notch on its upper end to receive an internally threaded, cylindrical fastener and at least one downwardly slanted notch in its forward edge for receiving said cylindrical fastener, the height of said cylindrical fastener being variable between said U-shaped notch and said slanted notch when used with said accessory, said cylindrical fasteners being adapted for attachment to the rear axle of a bicycle, the rear wheel of said bicycle being supported slightly above the upper surface of said rectangular bar for free rotational movement thereabove, a wheel, said wheel being stationarily fastened by fastening means to the end of said rectangular bar, adjacent said rearward, U-shaped clamp and extending substantially vertically upward therefrom, such that when the drive wheel axle of a bicycle is supported within said U-shaped notch or said slanted notch by said cylindrical fasteners, the drive wheel of a bicycle will frictionally engage the outer periheral surface of said wheel, said rectangular bar being forwardly and rearwardly adjustable to increase, or decrease, frictional engagement between said wheel of a bicycle supported on said accessory for increasing or decreasing the force required to turn said wheel by an exerciser, wherein the adjustable locking means comprises the forward clamp member having a tooth on an underside thereof selectively engaging between ratchet teeth upon an upper side of said rectangular bar, said bar being downwardly movable against a compression coil spring upon said tubular base member, so as to selectively disengage said teeth, and a block being mounted upon an upper side of said rectangular bar for being pushed by said exerciser's foot either forwardly or rearwardly.

* * * * *